United States Patent [19]

Brasa

[11] 4,372,203

[45] Feb. 8, 1983

[54] DOCTOR-BLADE SUPPORT MEANS FOR SILK SCREEN PRINTING MACHINE

[76] Inventor: Umberto Brasa, Via Ippolite Nievo No. 8, Milan, Italy

[21] Appl. No.: 61,659

[22] Filed: Jul. 30, 1979

[51] Int. Cl.[3] ..... B41L 13/18

[52] U.S. Cl. ..... 101/124; 101/119

[58] Field of Search ..... 101/115, 119, 120, 123, 101/124, 116, 167, 169

[56] References Cited

U.S. PATENT DOCUMENTS

| | | | |
|---|---|---|---|
| 1,832,216 | 11/1931 | Johnston et al. | 101/124 |
| 2,278,227 | 3/1942 | Thackeray et al. | 101/115 |
| 2,852,252 | 9/1958 | Sperry | 101/120 X |
| 2,928,340 | 3/1960 | Stein et al. | 101/115 X |
| 3,018,724 | 1/1962 | Nash | 101/115 X |
| 3,196,786 | 7/1965 | Hornberger et al. | 101/247 X |
| 4,138,943 | 2/1979 | Mitter | 101/120 X |

FOREIGN PATENT DOCUMENTS

| | | | |
|---|---|---|---|
| 2037490 | 2/1972 | Fed. Rep. of Germany | 101/120 |
| 2218818 | 11/1972 | Fed. Rep. of Germany | 101/120 |
| 1350812 | 4/1974 | United Kingdom | 101/120 |

*Primary Examiner*—Paul T. Sewell
*Assistant Examiner*—C. A. Pearson
*Attorney, Agent, or Firm*—Silverman, Cass & Singer, Ltd.

[57] ABSTRACT

For use in a silk screen printing machine including an impression cylinder and a doctor-blade mounted parallel to the surface of the impression cylinder for movement relative thereto; a doctor-blade supported at opposite axial ends respectively by a pair of fluid pressure operated piston and cylinder devices and flow control valves are disposed between a source of pressurized fluid and the devices respectively for raising and lowering the doctor-blade relative to the impression cylinder. A cam mounted for rotation with the impression cylinder coacts with a switch to operate the control valves.

Combined with the above are a pair of additional piston and cylinder devices coupled to said doctor-blade support, and associated control valves for controlling the pressure or force applied by the doctor-blade to the surface of the impression roller.

8 Claims, 2 Drawing Figures

DOCTOR-BLADE SUPPORT MEANS FOR SILK SCREEN PRINTING MACHINE

BACKGROUND OF THE INVENTION

This invention relates generally to the silk screen printing art and more particularly is concerned with the provision of a silk screen printing machine which includes an impression cylinder, a doctor-blade mounted for movement relative to said impression cylinder and improved fluid pressure operated means for mounting said doctor-blade and enabling controlled movement thereof relative to said impression cylinder.

As known, the doctor-blade of a silk screen printing machine is carried by a beam and disposed parallel to the surface of the impression cylinder of the machine. The beam is supported at opposite ends respectively by two internally threaded hollow columns. These columns slidably receive respective externally threaded shafts of respective electric motors. Movement of the doctor-blade relative to the impression cylinder is enabled by corresponding relative movement of the threaded shafts and hollow columns driven by the respective electric motors. Control is achieved by microcontacts disposed in the electric circuits operating the motors. While functionally satisfactory, such arrangement is complex and expensive.

SUMMARY OF THE INVENTION

For a silk screen printing machine of the type including an impression cylinder and a doctor-blade arranged parallel to the surface of the impression cylinder and being movable relative thereto, support means for carrying said doctor-blade including a support member, fluid operable piston and cylinder means coupled to said support member at opposite ends thereof, a source of pressurized fluid, conduit means coupling said source to said piston and cylinder means and flow control means intercepting the flow of pressurized fluid along said conduit means for selectively raising and lowering said doctor-blade relative to the surface of the impression cylinder.

Combined with the above are a pair of additional piston and cylinder devices coupled to said doctor-blade support and associated central valves for controlling the pressure or force applied by the doctor-blade to the surface of the impression roller.

DESCRIPTION OF THE PREFERRED EMBODIMENT

Figure 1:
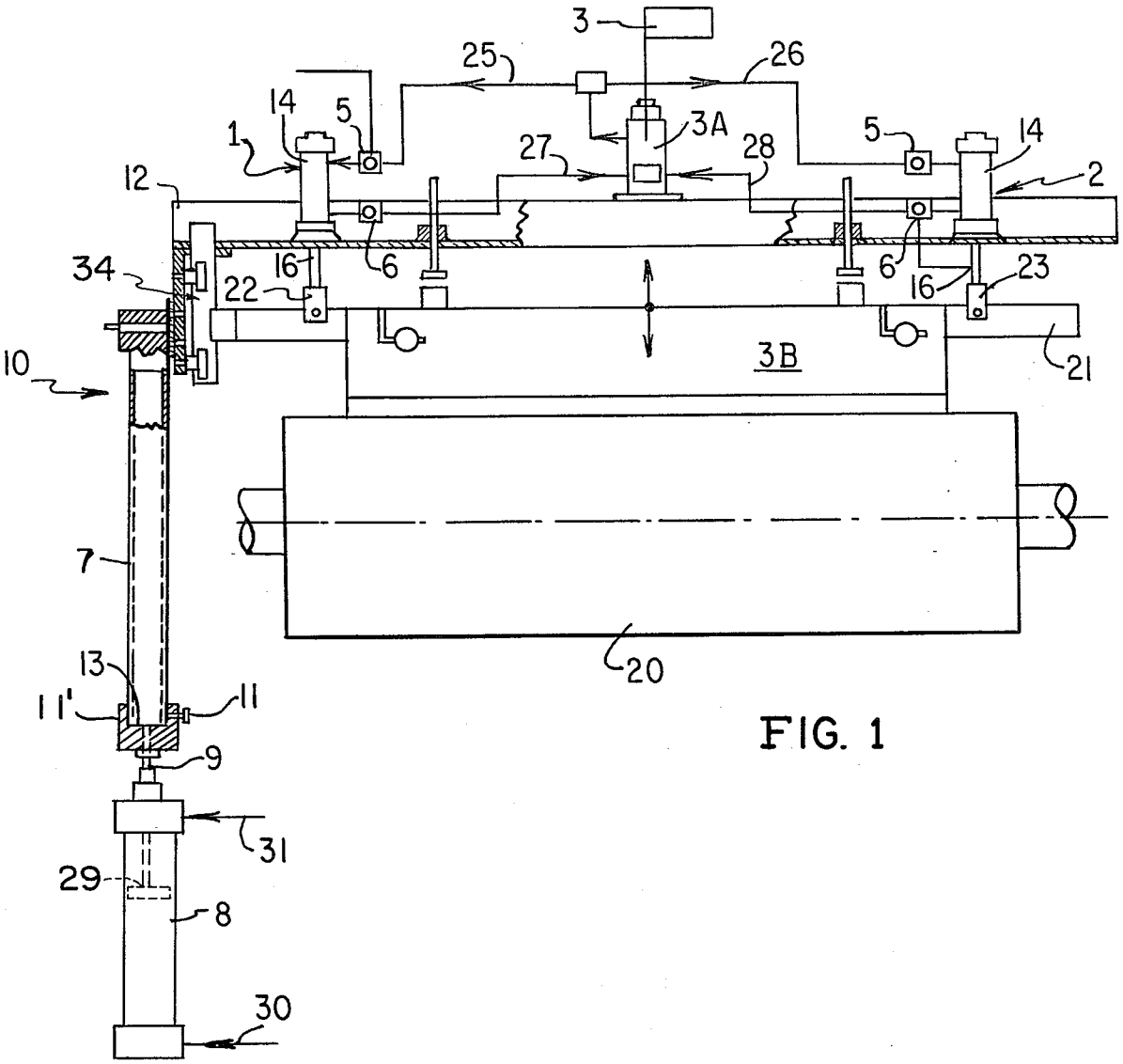
FIG. 1 is a diagrammatic front elevational view of a silk screen printing machine having the doctor-blade support means of the invention incorporated therein.

This invention generally provides a "floating" support for the doctor-blade of a silk screen printing machine having fluid pressure operated means coupled to the support for selectively controlling the pressure exerted by the doctor-blade upon the adjacent impression cylinder.

In the drawing, the silk screen printing machine is designated generally by reference character 10 and includes an impression cylinder 20 and a doctor-blade

3B arranged parallel to the rotational axis of impression cylinder 20. The doctor-blade 3B is supported on a beam 21. Cylinders 14 of double acting fluid pressure operated devices 1 and 2 are secured to the frame 12 of the machine 10. The piston rods 16 depend from the cylinders 14 and are coupled via articulated joints 22,23 to the doctor-blade support beam 21. Fluid pressure pipes or conduits 25, 26, 27 and 28 connect a source of fluid pressure, here an air compressor 3, via an electrically operable valve 3A to the cylinders 14 of the devices 1 and 2. Lines 25 and 26 are connected to the respective cylinders 14 above the corresponding piston heads (not shown) of piston rods 16 and lines 27 and 28 are connected to the respective cylinders below the piston heads (not shown) of corresponding piston rods 16 of cylinders 1 and 2.

A pair of manually operable control valves 5 are disposed in the respective lines 25 and 26. Valves 5 enable the pressure exerted on the piston heads of pistons 16 of devices 1 and 2 to be varied as required. Another pair of control valves 6 are disposed in the respective return lines 27 and 28 to control the rate of return of air to the air compressor 3 from the cylinders of devices 1 and 2.

Accordingly, the downward speed of the pistons and consequently the force exerted upon the impression roller via the doctor-blade is controlled by controlling the pressure exerted on the pistons 1 and 2 which can be varied as required.

The compressor may be an integral part of the machine 10 or may be a centralized compressor used for other purposes.

Figure 2:
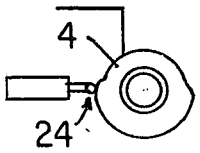
FIG. 2 is a detail of the control means provided for raising and lowering the doctor-blade relative to the impression cylinder of FIG. 1.

A cam 4 is illustrated in FIG. 2 and is coupled for rotation with the impression cylinder 20 to engage and disengage the microswitch 24 for controlling the raising and lowering of the doctor-blade 3B.

Conventionally electric motors are utilized for actually lifting the doctor-blade 3B. Here, two pneumatically operable pistons and cylinder devices 8 are employed for such purpose and are positioned on opposite sides of the machine 10. In order to avoid redundancy, only the left-hand side piston and cylinder device 8 is shown in FIG. 1. The piston 29 has an extension 9 which is connected to a ring nut 11'. Ring nut 11' is connected to the lower end of hollow column 7 by screws 11 with the column 7 seated in blind bore 13 of nut 11'. The hollow columns 7 support the beam 21 which carries the doctor-blade 3B. Piston and cylinder devices 8 are supplied from air compressor 3 via conduits 30 and 31 for raising and lowering the corresponding column 7 and through them, via the coupling represented generally at 34, the doctor-blade 3B.

Accordingly, a more satisfactory control of the doctor-blade 3B is achieved. The downward descent of the doctor-blade 3B may be more positively controlled. Further, pressure applied by the doctor-blade 3B upon the impression cylinder 20 can be applied more selectively. If desired, by controlling the valves 5 and 6, pressure applied by the opposite ends of the doctor-blade 3B may be made equal or unequal, as desired.

Minor modifications in the functional elements described above are contemplated without departing from the spirit and scope of the invention as defined in the appended claims.

What I claim is:

1. For use in a silk screen printing machine of the type including an impression cylinder and a doctor-blade arrangement mounted parallel to the surface of the impression cylinder and support means carrying said doctor-blade and having opposite ends; a pair of vertically arranged, reciprocably movable bearing columns having their upper ends coupled to said support ends and their lower ends coupled to a pair of fluid pressure operated piston and cylinder devices, each piston having a plunger extending outward of the cylinder coaxial with with one of said bearing columns and coupling means linking each column with each plunger, respectively, said coupling means comprising a ring mounted upon each column and having a bore capable of receiving said plunger therein, said columns being coaxial with the respective pistons of said piston and cylinder devices, control valve means for controlling the flow of pressurized fluid from a source thereof to said fluid pressure operated piston and cylinder devices to raise and lower the bearing columns for moving the doctor-blade relative to the impression cylinder.

2. The structure as claimed in claim 1 in which each ring has a seat for receiving said bearing column therein and means for releasably fastening said column in said seat.

3. The structure as claimed in claim 1 and an air compressor, said piston and cylinder devices being pneumatically operable, conduit means coupling the output of said air compressor to said cylinders of said piston and cylinder devices and is selectively operable, valve means are interposed between said air compressor and the cylinders of said piston and cylinder devices respectively.

4. The structure as claimed in claim 1, and in combination therewith, a pair of second fluid pressure operable piston and cylinder devices, means coupling said doctor-blade to said second devices and selectively operable second valve means disposed between said second devices and the source of fluid pressure for independent control of the supply of fluid pressure to each of said second piston-cylinder devices for increasing and decreasing the force applied to the surface of the impression cylinder by the doctor-blade.

5. The structure as claimed in claim 4 and articulated joint means coupling the doctor-blade to said second piston-cylinder devices.

6. The structure as claimed in claim 4 in which said second valve means are manually operable.

7. The structure as claimed in claim 4 in which said doctor-blade has top and bottom edges, said second piston-cylinder devices being coupled to the doctor-blade near its top edge with the bottom edge facing the surface of the impression cylinder.

8. The structure as claimed in claim 4 in which said piston-cylinder devices are pneumatic.

* * * * *